US009533814B2

(12) United States Patent
Brooks

(10) Patent No.: US 9,533,814 B2
(45) Date of Patent: Jan. 3, 2017

(54) BAG IN BOX PACKAGING HAVING AN INSERTED PANEL FOR RECEIVING A SPOUT OF THE BAG

(71) Applicant: Scholle Corporation, Irvine, CA (US)

(72) Inventor: John Brooks, Leabrook (AU)

(73) Assignee: Scholle IPN Corporation, Northlake, IL (US)

( * ) Notice: Subject to any disclaimer, the term of this patent is extended or adjusted under 35 U.S.C. 154(b) by 234 days.

(21) Appl. No.: 14/456,744

(22) Filed: Aug. 11, 2014

(65) Prior Publication Data

US 2015/0041494 A1 Feb. 12, 2015

Related U.S. Application Data

(60) Provisional application No. 61/864,141, filed on Aug. 9, 2013.

(51) Int. Cl.

| | |
|---|---|
| ***B65D 35/56*** | (2006.01) |
| ***B65D 77/06*** | (2006.01) |
| ***B67D 3/04*** | (2006.01) |

(52) U.S. Cl.

CPC ..... *B65D 77/067* (2013.01); *B67D 3/04* (2013.01)

(58) Field of Classification Search

CPC ..... B65D 77/062; B65D 77/067; B67D 3/04

USPC ..... 222/541.1–541.6, 105, 183, 185.1; 229/117.03–117.35; 53/376.3–378.3

See application file for complete search history.

(56) References Cited

U.S. PATENT DOCUMENTS

| | | | | | |
|---|---|---|---|---|---|
| 2,099,257 | A | * | 11/1937 | Bergstein | B65D 5/4204 229/117.32 |
| 2,412,544 | A | * | 12/1946 | Waters | B65D 5/18 229/117.27 |
| 2,483,464 | A | * | 10/1949 | Johnson | B65D 5/001 206/499 |
| 2,954,901 | A | * | 10/1960 | Winstead | B65D 5/70 222/183 |
| 2,973,119 | A | * | 2/1961 | Parker | B65D 77/065 222/131 |
| 3,054,549 | A | * | 9/1962 | Humphrey | B65D 77/065 229/117.13 |

(Continued)

FOREIGN PATENT DOCUMENTS

| | | | |
|---|---|---|---|
| EP | 0361042 | * | 5/1986 |
| FR | 2573039 | * | 5/1986 |
| WO | 2009113920 A1 | | 9/2009 |

*Primary Examiner* — Paul R Durand
*Assistant Examiner* — Randall Gruby
(74) *Attorney, Agent, or Firm* — The Watson I.P. Group, PLC; Jovan N. Jovanovic; Vladan M. Vasiljevic

(57) ABSTRACT

A bag in box packaging including a flexible bag and an outer carton. The flexible bag defines a cavity, with a spout coupled thereto providing access to the cavity. The outer carton has a first sidewall and a second sidewall opposite the first side wall. A front wall extends therebetween. The inner spout retaining member further includes an inner spout retaining member. The inner spout retaining member includes a first panel that extends between the first sidewall and the second sidewall and is spaced apart from the front wall. The first panel includes a spout receiving slot extending thereinto. The spout of the bag is positionable within the spout receiving slot of the first panel, so as to position the spout between the first panel and the front wall. A spout locking member is structurally configured to maintain the spout within the spout receiving slot of the first panel.

12 Claims, 11 Drawing Sheets

(56) References Cited

U.S. PATENT DOCUMENTS 3,087,655 A * 4/1963 Scholle ..... B65D 77/065 222/105
3,119,544 A * 1/1964 Cope ..... B65D 5/4608 206/594
3,138,293 A * 6/1964 Roak ..... B65D 75/5816 222/105
3,206,075 A * 9/1965 Scholle ..... B67D 3/045 222/105
3,206,094 A * 9/1965 Humphrey ..... B65D 77/065 229/117.28
3,233,817 A * 2/1966 Casady ..... B65D 77/065 222/105
3,240,417 A * 3/1966 Andreini ..... B65D 5/5016 206/418
3,246,825 A * 4/1966 Zastrow ..... B65D 5/70 220/592.19
3,333,392 A * 8/1967 Calvert ..... B65D 77/065 229/117.3
3,349,986 A * 10/1967 Chapman ..... B65D 5/76 206/588
3,363,807 A * 1/1968 Powell ..... B65D 77/067 222/105
3,371,824 A * 3/1968 Goss ..... B65D 77/06 222/105
3,765,574 A * 10/1973 Urquiza ..... B65D 21/0209 206/504
4,069,917 A * 1/1978 Stollberg ..... B65D 85/52 206/423
4,333,752 A * 6/1982 Thies ..... B01D 53/0415 206/0.5
4,445,613 A * 5/1984 Cassidy ..... B65D 5/5011 206/418
4,524,883 A * 6/1985 Herring ..... B65D 77/065 206/509
4,548,318 A * 10/1985 Boyle ..... B65D 5/48014 222/541.6
4,696,840 A * 9/1987 McCullough ..... B29C 49/24 222/105
4,919,306 A * 4/1990 Heaps, Jr. ..... B65D 77/061 222/105
4,927,042 A * 5/1990 Ring ..... B65D 77/062 206/431
5,049,349 A * 9/1991 McCullough ..... B65D 77/065 264/515
D321,647 S * 11/1991 Oldorf ..... D6/517
5,111,974 A * 5/1992 Parker ..... B65D 77/067 222/183
5,176,313 A * 1/1993 Curry ..... B65D 5/746 222/105
5,228,589 A * 7/1993 Della Riva ..... B65D 77/065 206/229
5,265,753 A * 11/1993 Moorman ..... B65D 77/065 206/588
5,462,169 A * 10/1995 Dygert ..... B65D 81/107 206/521
6,637,623 B2 * 10/2003 Muise ..... B65D 77/065 222/105
7,104,423 B2 * 9/2006 Smith ..... B65D 77/065 222/105
D617,635 S * 6/2010 Gould ..... D9/431
D671,405 S * 11/2012 Thomason ..... D9/431
8,474,655 B2 * 7/2013 Hackleman ..... B43L 25/00 222/105
8,511,538 B2 * 8/2013 Ouillette ..... B65D 5/46016 229/117.11
D703,529 S * 4/2014 Voelker ..... D9/430
2005/0211754 A1 * 9/2005 Fulcher ..... B65D 77/065 229/117.3
2006/0180643 A1 * 8/2006 Stephenson ..... B65D 5/46008 229/117.3
2006/0243783 A1 * 11/2006 Spivey ..... B65D 5/4208 229/117.3
2009/0159594 A1 6/2009 Nielsen et al.
2010/0116824 A1 * 5/2010 Stalions ..... B65D 77/067 220/495.06
2011/0031303 A1 * 2/2011 Zink ..... B65D 77/067 229/117.35

* cited by examiner

BAG IN BOX PACKAGING HAVING AN INSERTED PANEL FOR RECEIVING A SPOUT OF THE BAG

CROSS-REFERENCE TO RELATED APPLICATION

This application claims priority from U.S. Provisional Application Ser. No. 61/864,141 entitled "Bag in Box Packaging Having An Inserted Panel For Receiving A Spout Of The Bag," filed Aug. 9, 2014, the entire specification of which is hereby incorporated by reference.

BACKGROUND OF THE DISCLOSURE

1. Field of the Disclosure

The disclosure relates in general to bag in box packaging, and more particularly, to a bag in box packaging that has an inserted panel for receiving a spout of the bag.

2. Background Art

The use of bag in box packaging is ubiquitous. In certain applications, a user can dispense flowable material through a tap directly from the bag in box packaging. One such application is wine dispensing, although, the invention is not limited to the same.

Conventionally, a bag having a fluid therewithin (such as, for example, wine) is provided. A tap is provided over a spout that is welded to the bag. The tap may comprise any number of different spouts that are conventionally used in such an application. The filled bag is dropped into an outer box. The outer box includes a removable portion which corresponds to the location of the tap within the outer box.

To access the tap, the user punctures the box proximate the removable portion and reaches into the box for the tap. The tap is then directed out of the box and one of the tap and the spout are coupled to the box. The tap can then be actuated to dispense product.

Problematically, for some users it is difficult to couple the tap to the outer box. Thus, the tap becomes difficult, if not impossible to use. In other instances, the tap may become dislodged from the outer box during use.

In addition, due to the manner in which the tap and bag are inserted into the outer box, there are many instances where the tap lies in an orientation which is difficult to reach. Furthermore, inasmuch as the opening in the box is typically used to secure the tap to the outer box, the opening is often too small to allow for a user to delve deeply into the outer box.

SUMMARY OF THE DISCLOSURE

The disclosure is directed to a bag in box packaging a flexible bag and an outer carton. The flexible bag defines a cavity, with a spout coupled thereto providing access to the cavity. The outer carton has a first sidewall and a second sidewall opposite the first side wall. A front wall extends therebetween. The inner spout retaining member further includes an inner spout retaining member. The inner spout retaining member includes a first panel that extends between the first sidewall and the second sidewall and is spaced apart from the front wall. The first panel includes a spout receiving slot extending thereinto. The spout of the bag is positionable within the spout receiving slot of the first panel, so as to position the spout between the first panel and the front wall. A spout locking member is structurally configured to maintain the spout within the spout receiving slot of the first panel.

In some configurations, the inner spout retaining member further comprises a first sidewall engaging panel that extends from the first panel. The first sidewall engaging panel overlies and is adhered to the first sidewall. A second sidewall engaging panel extends from the first panel opposite the first side wall engaging panel. A second sidewall engaging panel overlies and is adhered to the second sidewall.

In some configurations, one of the first and second sidewall engaging panels extends away from the front panel. The other of the first and second sidewall engaging panels extends toward the front panel. The folding of the outer carton into a substantially flat configuration is achieved without the inner spout retaining member being folded over itself.

In some configurations, the spout locking member further comprises a bottom encapsulating panel hingedly coupled to the inner spout retaining member proximate a first sidewall thereof or to the first sidewall. The spout locking member further includes a front flap hinged to the bottom encapsulating panel. The front flap has a spout locking slot. Rotation of the bottom encapsulating panel directs the front flap into engagement with the spout receiving slot so as to capture the spout between the spout receiving slot and the front flap.

In some configurations, the bottom encapsulating panel is integrally formed with the first sidewall engaging panel, the second sidewall engaging panel and the first panel of the spout retaining member.

In some configurations, the outer carton includes a frangible portion which includes the front wall, which corresponds to the spout, such that upon removal thereof, the spout is accessible by a user.

In some configurations, the frangible portion extends over a portion of the front wall, the first sidewall, the second sidewall and a bottom wall portion the bottom wall portion adjacent the front wall.

In some configurations, the front wall may be positioned as a sidewall or as a top wall of the outer carton when in use.

In some configurations, the spout locking member further comprises a spout foot having a spout interfacing side and a pair of opposing sidewalls. The sidewalls are configured to correspond with the spout receiving slot so as to be captured therewithin. By positioning of the spout foot within the spout receiving slot, the spout interfacing side of the spout foot engages the spout so as to maintain the spout within the spout receiving slot of the first panel.

In some configurations, the spout foot includes a interfacing side which engages with the spout to preclude rotation of the spout relative to the spout foot.

In some configurations, the spout foot comprises a polymer member.

In some configurations, the spout includes a plurality of flanges with the spout receiving slot extending between the plurality of flanges of the spout.

In some configurations, the outer carton further includes a back wall opposite the front wall, a bottom wall structure extending between the first sidewall and the second sidewall and the front wall and the back wall at one end thereof and a top wall structure opposite the bottom wall structure.

In some configurations, the outer carton is configured so as to be positioned on an outside surface with the bottom wall structure in abutment therewith and with the spout being positioned proximate a location wherein the front wall and the bottom wall structure meet.

In some configurations, the outer carton is configured so as to be positioned on an outside surface with the back wall in abutment therewith and with the spout being positioned proximate a location wherein the front wall and the bottom wall structure meet.

BRIEF DESCRIPTION OF THE DRAWINGS

The disclosure will now be described with reference to the drawings wherein.

DETAILED DESCRIPTION OF THE DISCLOSURE

Figure 1:
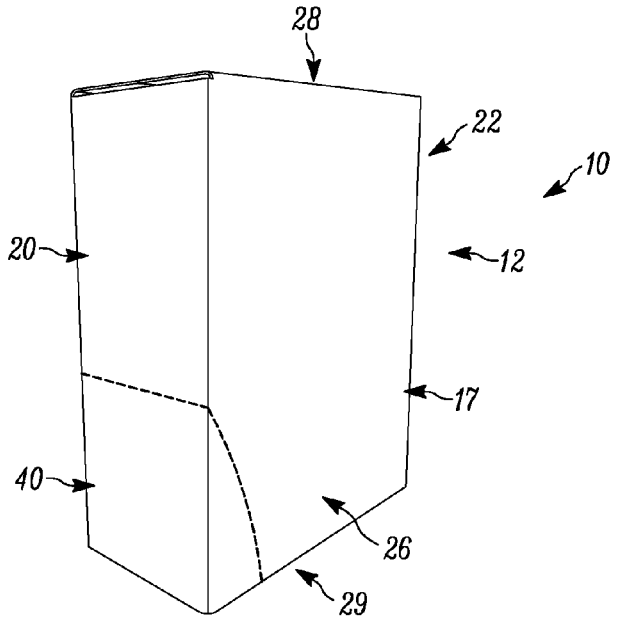
FIG. 1 of the drawings is a perspective view of the bag in box packaging of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
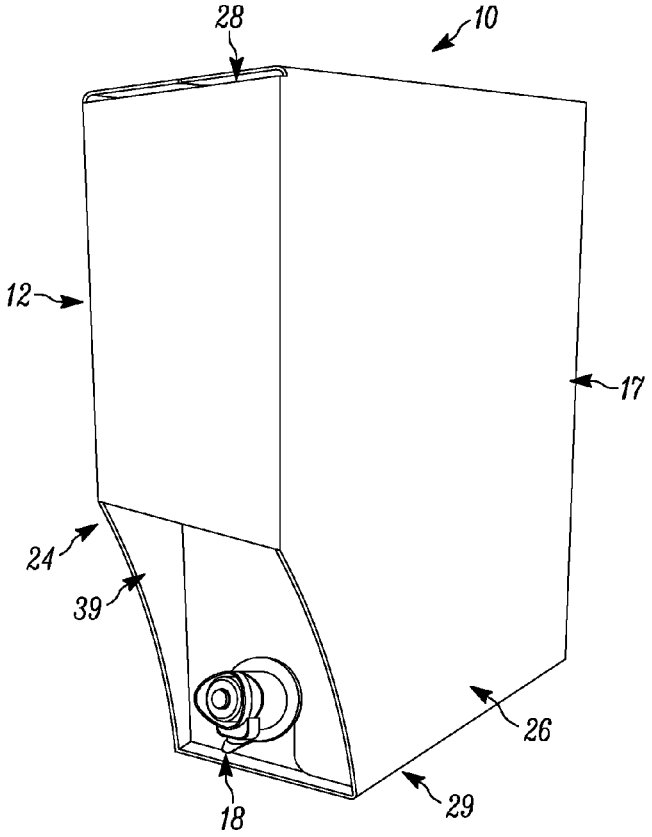
FIG. 2 of the drawings is a perspective view of the bag in box packaging of the present disclosure, showing, in particular, the frangible portion removed exposing the tap coupled to the inner bag.
Figure 3:
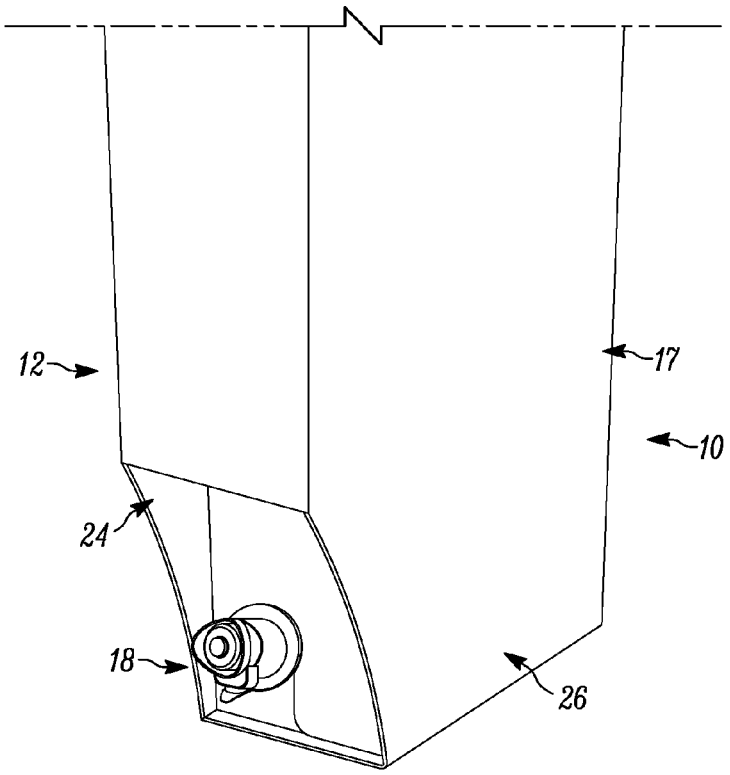
FIG. 3 of the drawings is a perspective view of the bag in box packaging of the present disclosure, showing, in particular, a close-up of the box after removal of the frangible portion.
Figure 4:
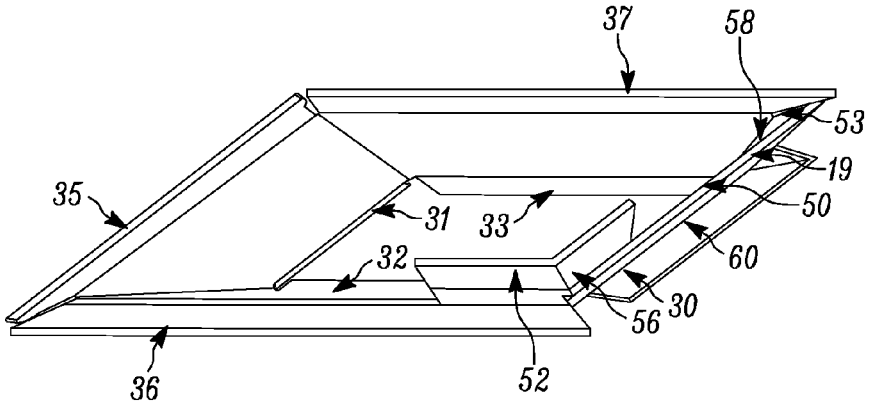
FIG. 4 of the drawings is a top plan view of the outer carton of the bag in box packaging of the present disclosure, showing, in particular, the parallelogram configuration that the box is urged into/out of during flat shipping.
Figure 5:
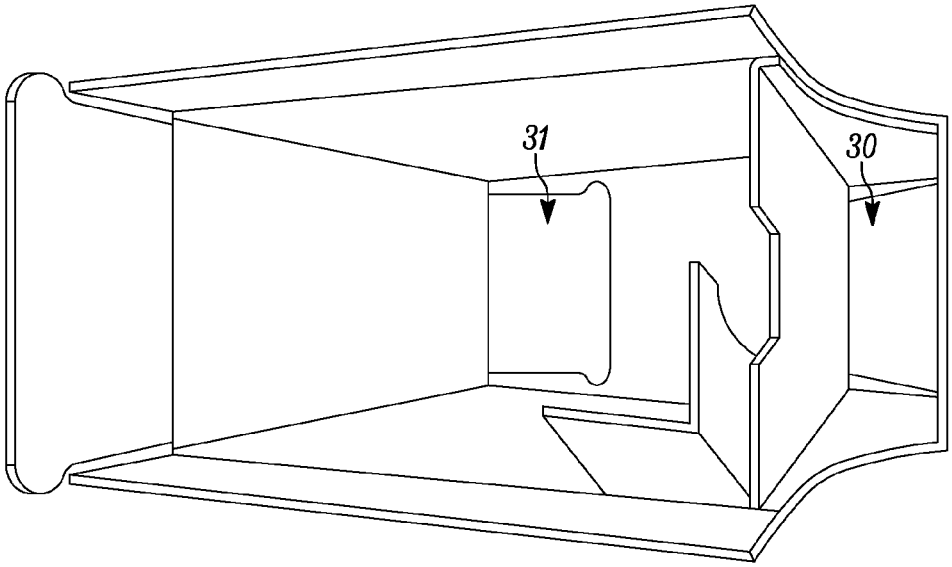
FIG. 5 of the drawings is a top plan view of the outer carton of the bag in box packaging of the present disclosure.
Figure 6:
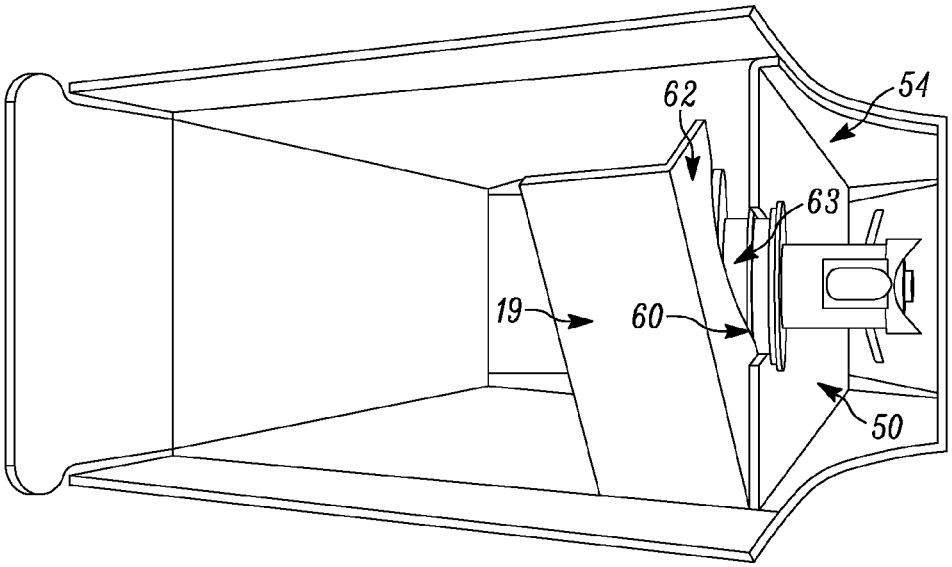
FIG. 6 of the drawings is a top plan view of the outer carton of the bag in box packaging of the present disclosure, showing, in particular, a tap and spout positioned within the spout receiving slot of the first panel of the inner spout retaining member.
Figure 7:
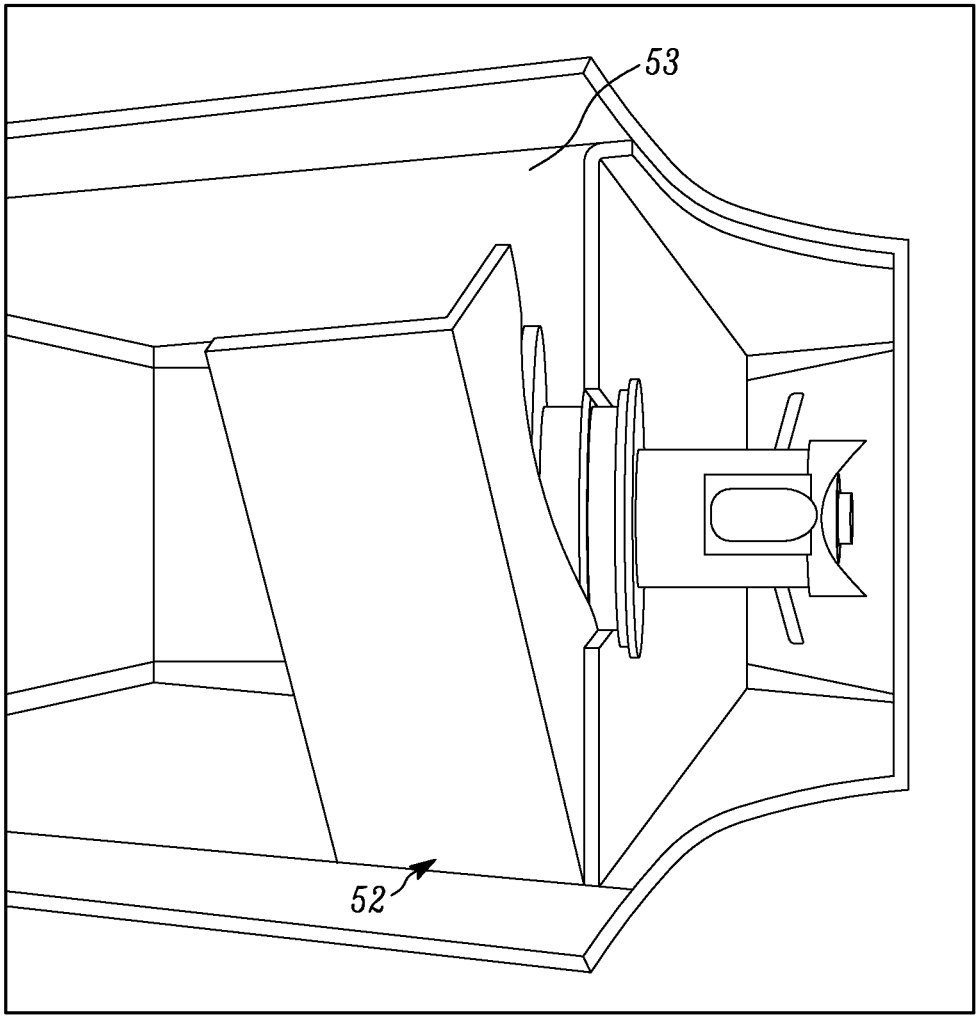
FIG. 7 of the drawings is a partial top plan view of the outer carton of the bag in box packaging of the present disclosure, showing, in particular, a tap and spout positioned within the spout receiving slot of the first panel of the inner spout retaining member.

Referring now to the drawings and in particular to FIGS. 1 through 3, bag in box packaging 10 is shown in FIG. 1 as comprising outer carton 12, inner bag 16 (FIG. 17), and tap 18. The outer carton 12 is shown as comprising outer walls 17 and inner spout retaining member 19. Generally, the outer carton 12 is formed from a corrugated paperboard material. Of course, other materials, such as non-corrugated paperboard as well as different polymer sheeting materials (corrugated and non-corrugated) are likewise contemplated. Additionally, other formed materials that can be formed into such configurations are contemplated for use.

With additional reference to FIGS. 4 through 7, the outer walls 17 form a generally rectangular cubic configuration, although other configurations are likewise contemplated (such as, for example, square configurations as well as configurations that are polygonal, trapezoidal, etc.). In the configuration shown in FIG. 1, the outer walls 17 include front wall 20, back wall 22, first sidewall 24, second sidewall 26 top wall structure 28 and bottom wall structure 29. The walls abut each other at edges, and the edges meet at corners. It will be understood that the first and second sidewalls span between the front wall and the back wall on opposing sides of each other. The top wall structure closes the upper portion of the carton with the bottom wall structure forming the lower portion of the carton. It will be understood that the outer walls 17 are formed from a blank which has the front, back and side panels being sequentially positioned in an adjacent side by side manner, defining the four panels, separated by fold lines. A tab may extend from the first panel which mates with the fourth panel to form the four walls in a generally rectangular configuration.

The top wall structure 28 is generally formed from four separate panels, each of which extends from one of the sidewalls or one of the front or back walls. The top wall structure 28 includes front flap 30 which extends from the front wall 20, back flap 31 which extends from the back wall 22, first side flap 32 which extends from the first sidewall 24, and second side flap 33 that extends from the second sidewall 26. Similarly, the bottom wall structure 29 includes front flap (not shown) 34 extending from the front wall 20, back flap 35 extending from the back wall 22, first side flap 36 extending from the first sidewall 24, and second side flap 37 extending from the second sidewall 26.

Figure 11:
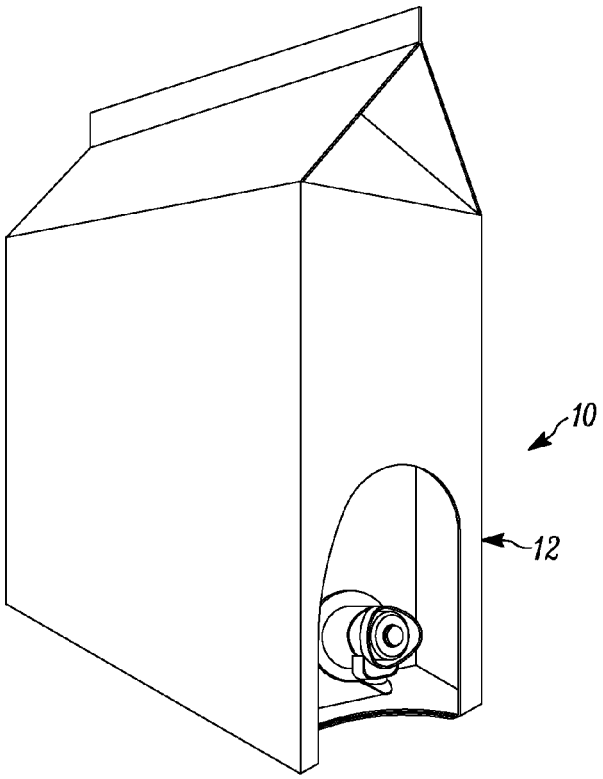
FIG. 11 of the drawings is a perspective view of an alternate configuration of the outer carton of the present disclosure.
Figure 12:
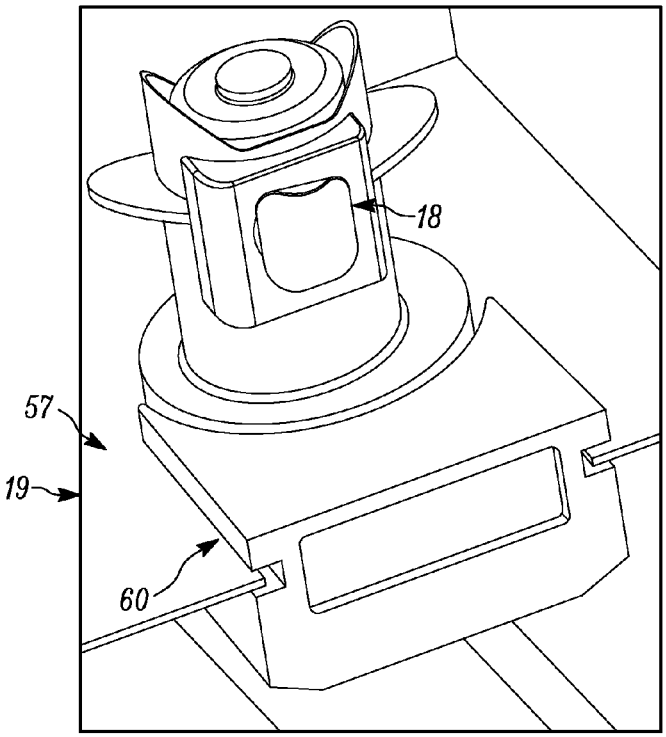
FIG. 12 of the drawings is a partial perspective view of the bag in box packaging, showing, in particular, the positioning of the spout foot within the spout receiving slot.
Figure 13:
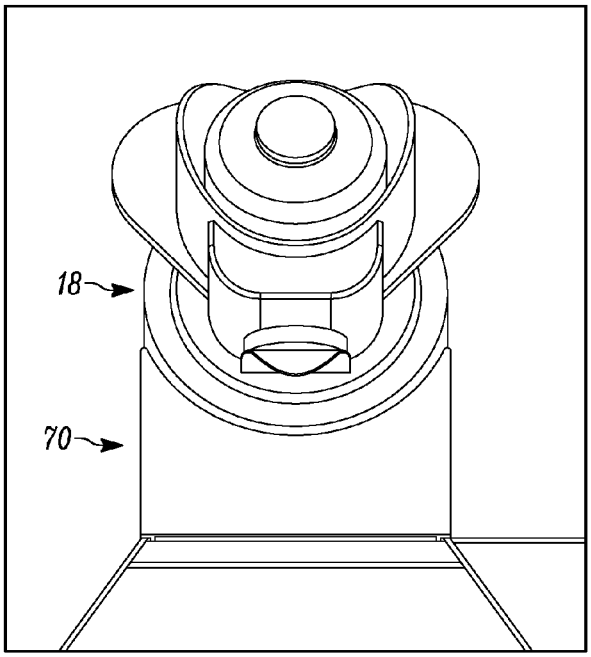
FIG. 13 of the drawings is a partial perspective view of the bag in box packaging, showing, in particular, the positioning of the spout foot within the spout receiving slot.
Figure 14:
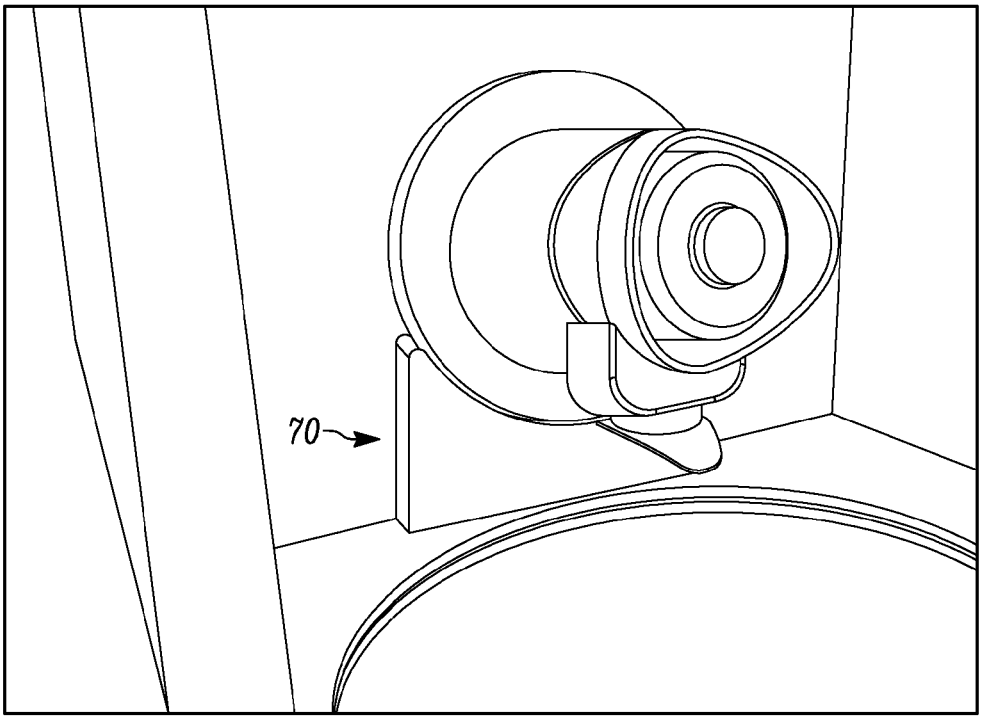
FIG. 14 of the drawings is a partial perspective view of the bag in box packaging, showing, in particular, the positioning of the spout foot within the spout receiving slot.
Figure 15:
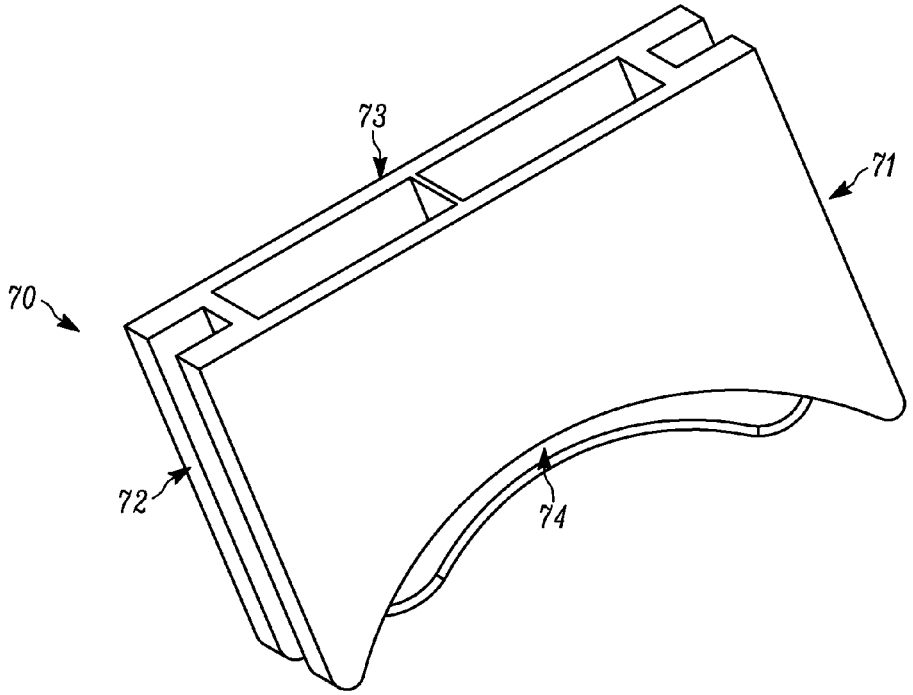
FIG. 15 of the drawings is a partial perspective view of the spout foot of the present disclosure.
Figure 16:
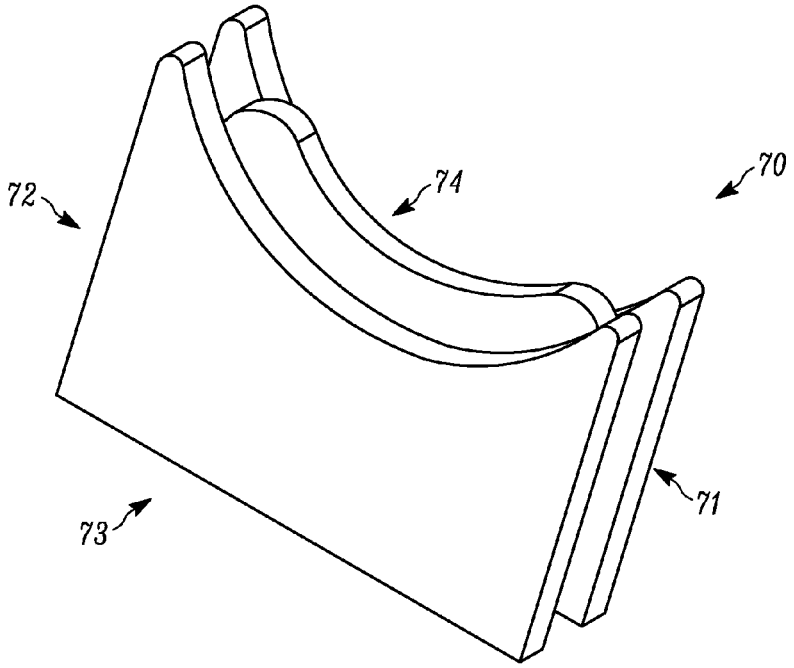
FIG. 16 of the drawings is a partial perspective view of the spout foot of the present disclosure.

It will be understood that in other embodiments, such as the embodiment of FIG. 11, the top wall structure may comprise something other than a conventional flat formed top. For example, the top wall structure may comprise a gable top structure or the like. Of course, other structures are likewise contemplated, as are provisions for hand grasping openings, handles and the like.

Figure 20:
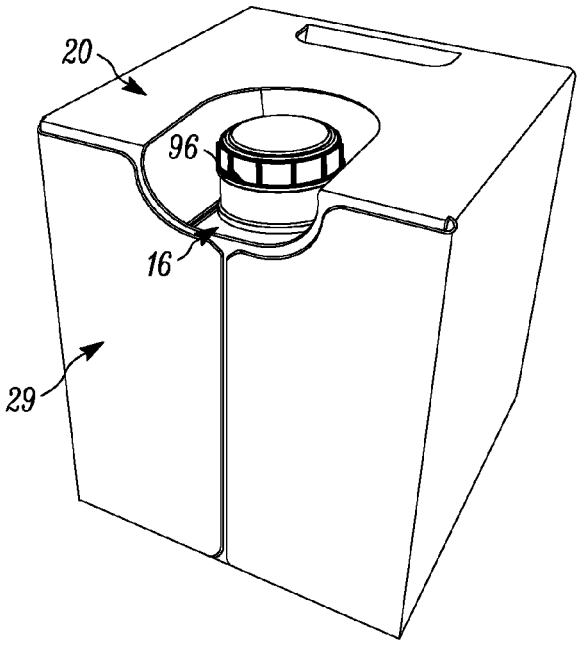
FIG. 20 of the drawings is a perspective view of another configuration of the bag in box packaging of the present disclosure, showing a configuration wherein the outer carton is configured to rest on the back wall, and wherein handles are provided to aid with lifting, rotating and dispensing from the position shown.
Figure 21:
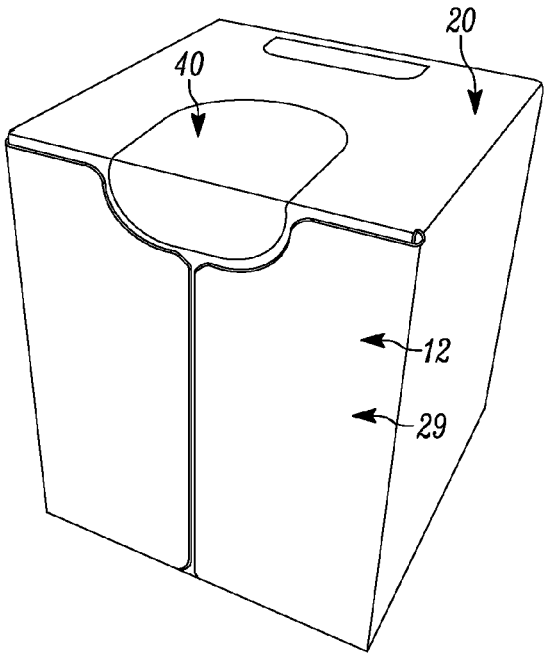
FIG. 21 of the drawings is a perspective view of the configuration of FIG. 20, showing, in particular, the configuration prior to the removal of the frangible portion.

For example, and with reference to FIGS. 20 and 21, the container may be positioned on a surface other than the bottom wall structure. That is, the reference to the different walls is not limiting in that the container may be positioned in a different orientation than on the bottom wall, and, for example, on the back wall. In such a configuration, the spout can be configured to receive a twist off cap. Additionally, a handle may be provided on any one of the panels, such as the front wall structure or the top wall structure to aid in the dispensing from such a container. Indeed, in other respects of retention of the spout and the like, the container of FIG. 20 has the same configurations as the containers of the remaining figures, and in particular the inner spout retaining member.

Referring again to FIGS. 4 through 7, the inner spout retaining member 19 spans between the first sidewall 24 and the second sidewall 26 in a spaced apart orientation from the front wall 20 and generally parallel thereto. The inner spout retaining member 19 includes first panel 50, first sidewall engaging panel 52, second sidewall engaging panel 53 and bottom encapsulating panel 56. The inner spout retaining member 19 is formed from a blank having an outside surface 58 and an inside surface 57. It is generally formed from a corrugated paperboard material, although other materials are likewise contemplated.

With reference to the FIGS. 4 through 7, the first sidewall engaging panel 52 overlies and is glued to the first sidewall 24 about the outside surface 58. On the opposing side, the second sidewall engaging panel 53 overlies and is glued to the second sidewall 26 about the inside surface 57. As such, the sidewall engaging panels are offset relative to each other and not directly opposite each other, with the first panel being substantially parallel to the front panel. Such a configuration aids in the flat packing of the partially assembled carton in that the inner spout retaining member 19 does not overlie itself, while folding into a lay flat configuration.

The first panel 50 further includes a spout receiving slot 60 at the lower end thereof which is configured to engage a spout of a bag (or a tap coupled to the spout of a bag). Generally, the spout receiving slot 60 is centrally located on the first panel 50 and opens toward the bottom wall structure, such that, when closed, the end of the spout receiving slot generally abuts or is positioned proximate the bottom wall structure. It will be understood that the first panel may substantially correspond in shape to the front wall such that two cavities are defined within the container by the first panel, with access between the two cavities limited substantially to the spout receiving slot. In other embodiments, the front panel may be smaller in configuration than the front wall, such that the front panel terminates out of view of the user when the frangible portion is removed. Thus, to the user, it is not clear exactly how far beyond the frangible portion the front panel extends. That is, the front panel may stop well short of the top wall structure, but extend beyond that which can be reasonably seen when the frangible portion is removed.

The bottom encapsulating panel, also referred to as a spout locking member extends from a bottom edge of one of the sidewall engaging panels and is generally configured to rotate about the same axis as one of the side flaps of the bottom wall structure. The bottom encapsulating panel includes a front flap that is configured to be substantially parallel to the front panel 50 of the spout retaining member. The front flap is positionable so as to be in an abutting relationship with the front panel. The front flap 62 includes spout locking slot 63 which substantially matches the spout receiving slot 60 so that together they can engage and lock the spout in a generally fixed position. It will be understood that the bottom encapsulating panel may be integrally formed with the remainder of the spout retaining member 19.

In another embodiment, the spout locking member may comprise a spout foot member 70 (FIGS. 12 through 16) which is positioned so as to lock the spout within the spout receiving slot. The spout foot 70 includes a substantially planar spacer member that fills the space within the spout receiving slot that is not occupied by the spout which is between the spout and the bottom wall structure 29. As such, the spout foot includes opposing sidewalls 71, 72 having slots that interface with the wall structure on either side of the spout receiving slot, a base 73 and a tap/spout interfacing side 74. The base interfaces with the bottom wall structure and preserves the relative spacing of the spout/tap relative to the base wall. Additionally, such a spout foot assembly allows for quicker assembly than would otherwise be possible. Further, such a spout foot may include an anti-rotation tab or the like to preclude the rotation of the spout/tap/cap relative to the outer carton. It will also be understood that the spout receiving slot and the spout itself may have cooperative geometries that preclude the rotation of one relative to the other.

Figure 17:
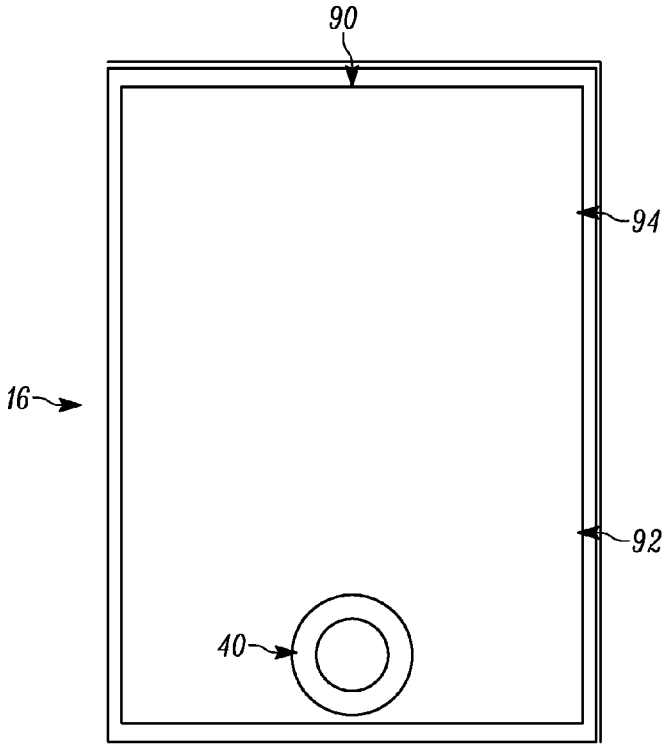
FIG. 17 of the drawings is a front view of an inner bag for use in association with the present disclosure.
Figure 18:
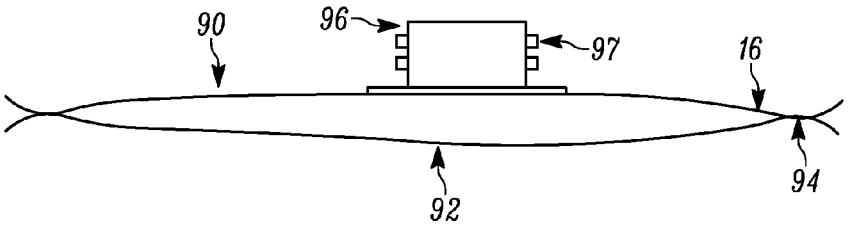
FIG. 18 of the drawings is a cross-sectional view of the inner bag of FIG. 17.

Generally, and with reference to FIG. 17, the inner bag 16 that is associated with such a bag in box package comprises a pillow type container having a front panel 90, a back panel 92, seals 94 that couple the front panel to the back panel to define a generally rectangular or square cavity. A spout 96 is generally coupled to an opening in the front panel 90 so as to provide ingress into the cavity. The spout typically includes a base flange that is coupled to the bag and a generally cylindrical upstanding tubular member extending from the base flange. The upstanding tubular member may include a plurality of flanges on the outside surface thereof. Typically, such flanges are utilized by filling equipment and also utilized to locate the spout within the bag in box package. Typically, the front and back panels may comprise a single or multi-layer laminate or co-extrusion, and may comprise a single or multi-ply configuration. In other embodiments, a gusseted bag, or other form fitting bag can be utilized in the place of a pillow type bag. The seals may be formed in any number of different manners. Additionally, the materials selected for each of the panels and the spout can be varied depending on the particular application.

Figure 19:
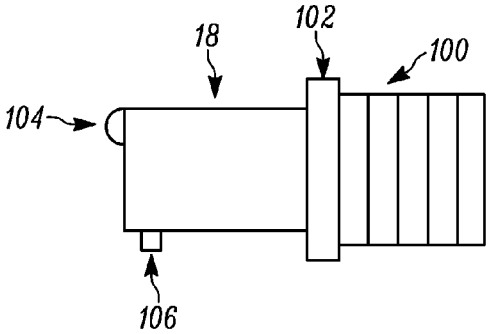
FIG. 19 of the drawings is a side elevational view of an exemplary tap of the present disclosure.

The tap is shown in FIG. 19 as comprising a spout interface 100, flange 102, actuator 104 and dispensing opening 106. Any number of different configurations are contemplated for the tap, and the disclosure is not limited to any particular tap configuration, or any particular tap. For example, one such tap comprises the tap shown in any one of the following patents, namely, U.S. Pat. Nos. 4,619,377 and 6,978,981 both of which are issued to Roos as well as U.S. Pat. Nos. 6,045,119; 6,296,157 and 6,360,925 issued to Erb, as well as, the tap shown in U.S. Pat. No. 8,336,743 issued to Bellmore. Of course, other taps are likewise contemplated, including, but not limited to caps that snap or twist onto the spout. The foregoing patents are incorporated by reference herein in their entirety. These taps are shown only for purposes of illustration, and are not deemed to be limiting or to in any manner limit the disclosure to the foregoing taps.

To assemble the container of the bag in box package of the present disclosure, the user is first provided with a blank or a partially folded box. In many instances, the box is partially formed and parallelogram folded so as to be flat for transportation. Once articulated, the front wall, back wall, and first and second sidewalls are fully formed. The top wall structure and the bottom wall structure remain open. The inner spout retaining member is in position and coupled to the opposing sidewalls. The front panel thereof is parallel to the front wall and spaced apart therefrom. The bottom encapsulating panel is rotated out of the container so as to provide access to the spout receiving slot 60 of the first panel 50.

The top wall structure is then assembled so as to form a three sided container with an open bottom wall structure. Generally the flaps of the bottom wall structure are folded and glued so as to be secured to each other.

Next, the bag is positioned into the cavity that is bound by the two sidewalls, the back wall and the inner spout retaining member. As the bag is further directed inward the spout and/or the tap is directed into contact with the spout receiving slot 60 of the inner spout retaining member 19. Often, the spout is positioned within the spout receiving slot with a such that the spout receiving slot material fits between a pair of spaced apart flanges on the outer surface of the tubular upstanding member of the spout. Further direction captures the spout (generally between flanges thereof), or the tap/spout (again between flanges or a combination of the two) within the spout receiving slot 60. The bag insertion continues until the entirety of the bag is within the cavity of the box. It will be understood that this can be accomplished after the bag has been filled with a predetermined amount of flowable material.

Once fully inserted into the box, the bottom encapsulating panel 56 can be rotated about its edge so that the front flap 62 is directed toward the spout receiving slot and toward the spout positioned therein. Eventually, the spout locking slot 63 of the front flap engages the spout and locks the spout into place. Generally, in such an orientation, the bottom encapsulating panel is positioned so as to extend between the first and second sidewalls.

In the embodiment wherein the spout locking member comprises a spout foot, the spout foot can be inserted into the spout receiving slot after insertion of the spout, to lock the two in engagement.

Once the bottom encapsulating panel is positioned in the desired orientation, the bottom wall structure is assembled so as to seal the bag within the box. The different flaps are folded about their respective edges until they have sealed the bottom of the box.

To use the bag in box assembly, the user is provided with the package. As will be understood, due to the frangible portion of the outer carton, the spout and tap remain removed from view and access. As such, the user grasps the frangible portion 40 and disconnects the same from the remainder of the outer carton. It will be understood that a number of different configurations are contemplated for the frangible portion 40 of the outer container. In certain embodiments, an angled corner cutout is contemplated, wherein the frangible portion 40 extends over the front wall, the opposing sidewalls and the bottom wall so as to expose the inner spout retaining member and the tap.

Figure 8:
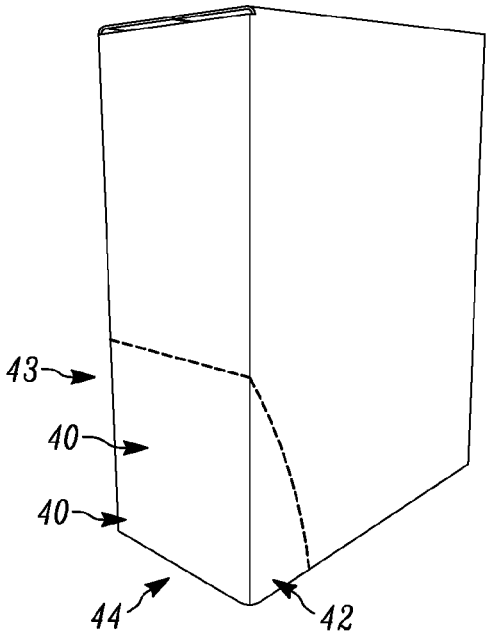
FIG. 8 of the drawings is a perspective view of the bag in box packaging of the present disclosure, showing, in particular, a configuration of the frangible portion.
Figure 9:
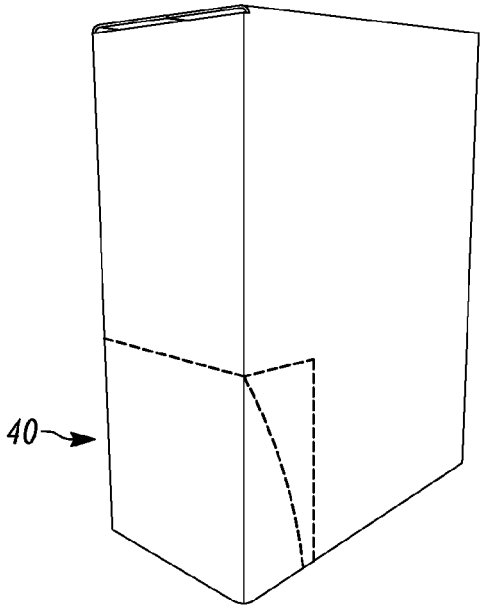
FIG. 9 of the drawings is a perspective view of the bag in box packaging of the present disclosure, showing, in particular, a configuration of the frangible portion.
Figure 10:
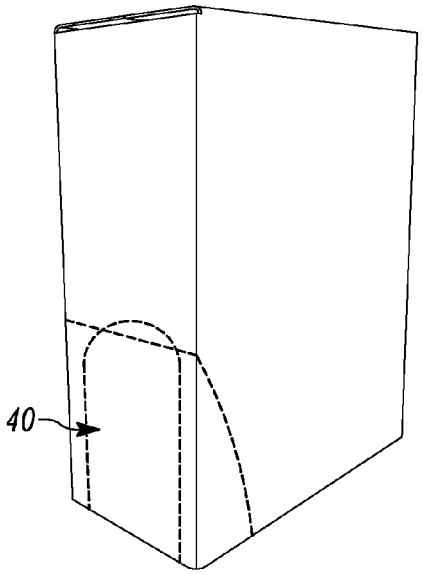
FIG. 10 of the drawings is a perspective view of the bag in box packaging of the present disclosure, showing, in particular, a configuration of the frangible portion.

In other embodiments, and with reference to FIGS. 8 through 10, different configurations are contemplated for the actual cut-out portion of the frangible portion to be modified so as to cover different portions of the sidewalls and the bottom wall. In yet other embodiments, the frangible portion may extend over a fewer number of walls (i.e., the bottom wall and the front wall solely).

In the configuration of FIGS. 20 and 21, the outer carton is configured to rest on the back wall so that the front wall is positioned distally from the surface and the spout is generally configured to open in an upward direction. In such a configuration, the user can grasp the additional handles to lift the package from the surface (if desired), and to rotate the packaging so as to dispense a flowable material from within the cavity of the inner bag. It will be understood, that in such a configuration, a twist on cap is generally provided in place of an actuatable tap. In addition, it will be understood that the capacity of the packaging may be on the order of 25 liters or the like, with the spout having an opening that can dispense at a desired rate of flow. The disclosure is not limited to any particular configuration of the packaging or to any particular size of packaging, spout or other structure.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A bag in box packaging comprising:

a flexible bag defining a cavity, with a spout coupled thereto providing access to the cavity;

an outer carton having a first sidewall and a second sidewall opposite the first side wall, and a front wall extending therebetween, an inner spout retaining member further comprising:

a first panel extending between the first sidewall and the second sidewall spaced apart from the front wall, the first panel including a spout receiving slot extending thereinto, wherein the spout of the bag is positionable within the spout receiving slot of the first panel, so as to position the spout between the first panel and the front wall; and a spout locking member structurally configured to maintain the spout within the spout receiving slot of the first panel, wherein the inner spout retaining member further comprises a first sidewall engaging panel extending from the first panel, with the first sidewall engaging panel overlying and adhered to the first sidewall, and a second sidewall engaging panel extending from the first panel opposite the first side wall engaging panel, with the second sidewall engaging panel overlying and adhered to the second sidewall; and wherein one of the first and second sidewall engaging panels extends away from the front wall and the other of the first and second sidewall engaging panels extends toward the front wall, whereupon folding of the outer carton into a substantially flat configuration precludes the inner spout retaining member from being folded over itself.

2. The bag in box packaging of claim 1 wherein the outer carton includes a frangible portion which includes the front wall, which corresponds to the spout, such that upon removal thereof, the spout is accessible by a user.

3. The bag in box packaging of claim 2 wherein the frangible portion extends over a portion of the front wall, the first sidewall, the second sidewall and a bottom wall portion the bottom wall portion adjacent the front wall.

4. The bag in box packaging of claim 2 wherein the front wall may be positioned as a sidewall or as a top wall of the outer carton when in use.

5. The bag in box packaging of claim 1 wherein the spout includes a plurality of flanges with the spout receiving slot extending between the plurality of flanges of the spout.

6. The bag in box packaging of claim 1 wherein the outer carton further includes a back wall opposite the front wall, a bottom wall structure extending between the first sidewall and the second sidewall and the front wall and the back wall at one end thereof and a top wall structure opposite the bottom wall structure.

7. The bag in box packaging of claim 6 wherein the outer carton is configured so as to be positioned on an outside surface with the bottom wall structure in abutment therewith and with the spout being positioned proximate a location wherein the front wall and the bottom wall structure meet.

8. The bag in box packaging of claim 6 wherein the outer carton is configured so as to be positioned on an outside surface with the back wall in abutment therewith and with the spout being positioned proximate a location wherein the front wall and the bottom wall structure meet.

9. A bag in box packaging comprising:

a flexible bag defining a cavity, with a spout coupled thereto providing access to the cavity;

an outer carton having a first sidewall and a second sidewall opposite the first side wall, and a front wall extending therebetween, an inner spout retaining member further comprising:

a first panel extending between the first sidewall and the second sidewall spaced apart from the front wall, the first panel including a spout receiving slot extending thereinto, wherein the spout of the bag is positionable within the spout receiving slot of the first panel, so as to position the spout between the first panel and the front wall; and a spout locking member structurally configured to maintain the spout within the spout receiving slot of the first panel, wherein the inner spout retaining member further comprises a first sidewall engaging panel extending from the first panel, with the first sidewall engaging panel overlying and adhered to the first sidewall, and a second sidewall engaging panel extending from the first panel opposite the first side wall engaging panel, with the second sidewall engaging panel overlying and adhered to the second sidewall; and wherein the spout locking member further comprises a bottom encapsulating panel hingedly coupled to the inner spout retaining member proximate a first sidewall thereof or to the first sidewall, the spout locking member further including a front flap hinged to the bottom encapsulating panel, the front flap having a spout locking slot, whereupon rotation of the bottom encapsulating panel, the front flap is directed into engagement with the spout receiving slot so as to capture the spout between the spout receiving slot and the front flap.

10. The bag in box packaging of claim 9 wherein the bottom encapsulating panel is integrally formed with the first sidewall engaging panel, the second sidewall engaging panel and the first panel of inner the spout retaining member.

11. The bag in box packaging of claim 9 wherein the spout locking member further comprises a spout foot having a spout interfacing side and a pair of opposing sidewalls, the sidewalls configured to correspond with the spout receiving slot so as to be captured therewithin, whereupon positioning of the spout foot within the spout receiving slot, the spout interfacing side of the spout foot engages the spout so as to maintain the spout within the spout receiving slot of the first panel.

12. The bag in box packaging of claim 11 wherein the spout foot comprises a polymer member.

* * * * *